US005226193A

United States Patent [19]

Chen

[11] Patent Number: 5,226,193

[45] Date of Patent: Jul. 13, 1993

[54] CHILD'S SLEEPING GARMENT

[76] Inventor: Yen-Chu Chen, No. 96, Ti Wu Hsing Tsun, Da Shih Cheng, Tao Yen Hsien, Taiwan

[21] Appl. No.: 675,960

[22] Filed: Mar. 27, 1991

Related U.S. Application Data

[63] Continuation-in-part of Ser. No. 533,397, Jun. 5, 1990, abandoned.

[51] Int. Cl.[5] ..... A41D 11/00

[52] U.S. Cl. ..... 2/69.5; 2/69; 2/80; 2/83

[58] Field of Search ..... 2/69, 69.5, 75, 70, 2/80, 84, 83, 86, 89, 94, 97, 108

[56] References Cited

U.S. PATENT DOCUMENTS

| | | | |
|---|---|---|---|
| 533,994 | 2/1895 | Loewenthal | 2/108 X |
| 715,248 | 12/1902 | Davis | 2/70 X |
| 1,236,586 | 8/1917 | Milkes | 2/69 X |
| 1,489,046 | 4/1924 | Thompson | 2/70 X |
| 2,121,788 | 6/1938 | Daiber | 2/69.5 |
| 2,320,783 | 6/1943 | Lee | 2/94 |
| 2,358,410 | 9/1944 | Malthesius | 2/69.5 |
| 2,580,024 | 12/1951 | Hoffman | 2/70 |
| 4,158,892 | 6/1979 | Gonzales | 2/69.5 |
| 4,426,740 | 1/1984 | Reverberi | 2/88 |
| 4,470,155 | 9/1984 | Maeshima | 2/108 |
| 4,575,876 | 3/1986 | Weaver | 2/69.5 |
| 4,703,521 | 11/1987 | Asher | 2/69 |
| 4,759,082 | 7/1988 | Mulligan | 2/75 X |
| 4,783,855 | 11/1988 | Njegovan | 2/84 X |
| 4,811,429 | 3/1989 | Perez | 2/70 X |
| 4,856,131 | 8/1989 | Mills | 2/69.5 |
| 4,864,656 | 9/1989 | Nesse | 2/108 X |
| 4,897,885 | 2/1990 | Lunt | 2/69.5 |
| 4,998,296 | 3/1991 | Stames | 2/69.5 |

FOREIGN PATENT DOCUMENTS

| | | | |
|---|---|---|---|
| 2163942 | 3/1986 | United Kingdom | 2/69.5 |

*Primary Examiner*—Werner H. Schroeder
*Assistant Examiner*—Jeanette E. Chapman
*Attorney, Agent, or Firm*—Cushman, Darby & Cushman

[57] ABSTRACT

A child's sleeping garment including an envelope, a pillow detachably associated with upper edges of the envelope, an elongating bag detachably associated with lower edges of the envelope for elongating the length thereof, and two sleeves detachably secured to the envelope, wherein the envelope has a front wall, a rear wall, a neck opening formed at upper edge of the envelope and two arm openings respectively formed on two side edges thereof, the front wall of the envelope being divided into two flaps which are detachably connected by a zipper whereby a child or an infant in the envelope can be kept warm and comfortable without any possibility of strangling himself through his turning movements in sleep, the sleeping garment permitting the child to do free movement of the legs and arms without being entangled and exposed to cold.

7 Claims, 6 Drawing Sheets

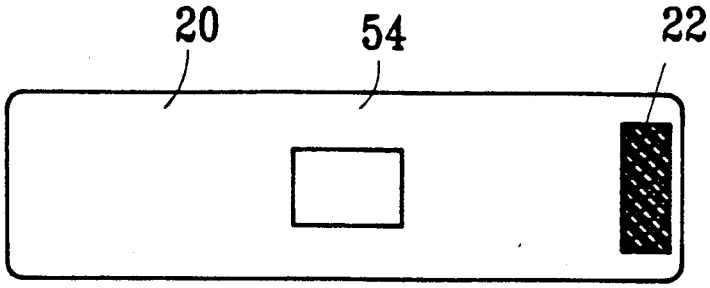
FIG.5A
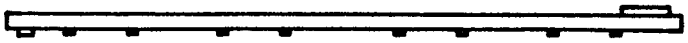
FIG.5B
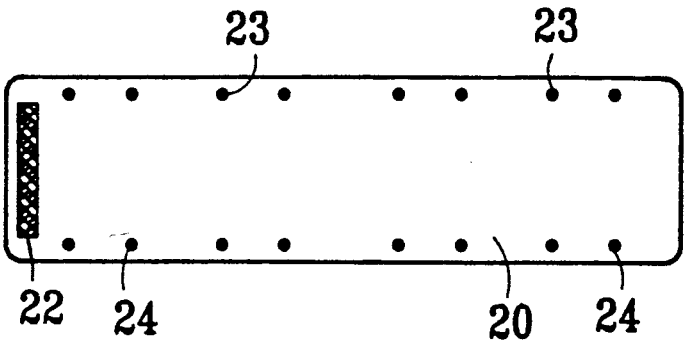
FIG.5C
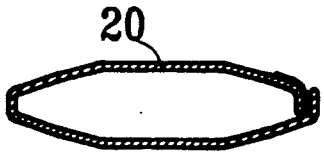
FIG.5D
FIG. 5G
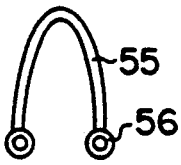
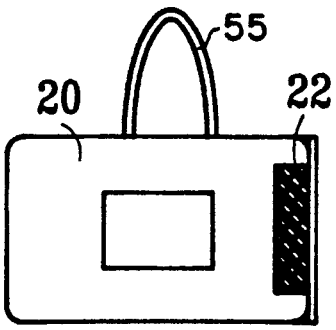
FIG.5E

CHILD'S SLEEPING GARMENT

CROSS-REFERENCE TO RELATED APPLICATION

This invention is a continuation-in-part application of parent patent application Ser. No. 07/533,397 filed on Jun. 5, 1990, now abandoned.

BACKGROUND OF THE INVENTION

The present invention relates to a sleeping garment for a child or an infant.

Various types of sleeping garments for children are known. Conventional sleeping bag for children is airtightly sewn so that the child or infant in the sleeping bag often feels excessively warm and uncomfortable in a not so cold time. Moreover, an infant often tends to tangle with the sleeping bag or become exposed to cold due to too warm temperature in the sleeping bag. Thus, sickness of children often results from an unsatisfactory sleeping bag.

Furthermore, an infant might slip into the sleeping bag and strangle itself through its turning movements in sleep, as is the case when a baby is covered with ordinary blankets and covers.

SUMMARY OF THE INVENTION

It is a primary object of this invention to provide a comfortable, convenient and safe sleeping garment for a child or an infant which will enable him to have the free use of his arms and insure safe warm sleeping so that the child is well covered at all times and will not become entangled in bedding.

It is a further object of this invention to provide the above sleeping garment wherein an elongating bag can be secured to the lower edge of the sleeping garment whereby a grown up child can still be well covered so that the using period of the sleeping garment is prolonged. The elongating bag can also serve as a carrying bag to store and carry the sleeping garment.

When taking off the elongating bag, the sleeping garment of this invention can fit on a grown up child, serving as a blouse. While when the elongating bag is secured to the sleeping garment, the sleeping garment can fit on a more grown child, serving as a sleepwear. The elongating bag can also be used alone as a stomach wrap to wrap the chest and abdomen of a child or an infant to prevent the same from catching a cold.

It is still a further object of this invention to provide the above sleeping garment which is designed to be used by children of many ages. Adjustments can make it suitable for newborns, toddles through approximately age 7. Moreover, a removable quilted interlining makes this invention suitable for all seasons, unlike those already patented. This invention is multifunctional and more versatile than other similar devices. It can serve as a vest, an infant sleeping bag, a nightshirt, a quilt, a dressing and a stomach wrap.

The present invention can be best understood through the following description and accompanying drawings wherein:

BRIEF DESCRIPTION OF THE DRAWINGS

FIG. 5A shows the outer face of the unfolded elongating bag;

FIG. 5B is a side elevation according to FIG. 5A;

FIG. 5C shows the inner face of the unfolded elongating bag;

FIG. 5D is a cross-sectional view of the folded elongating bag;

FIG. 5E shows the elongating bag which forms a carrying bag for storing and carrying the sleeping garment; and

DETAILED DESCRIPTION OF THE PREFERRED EMBODIMENT

Figure 1:
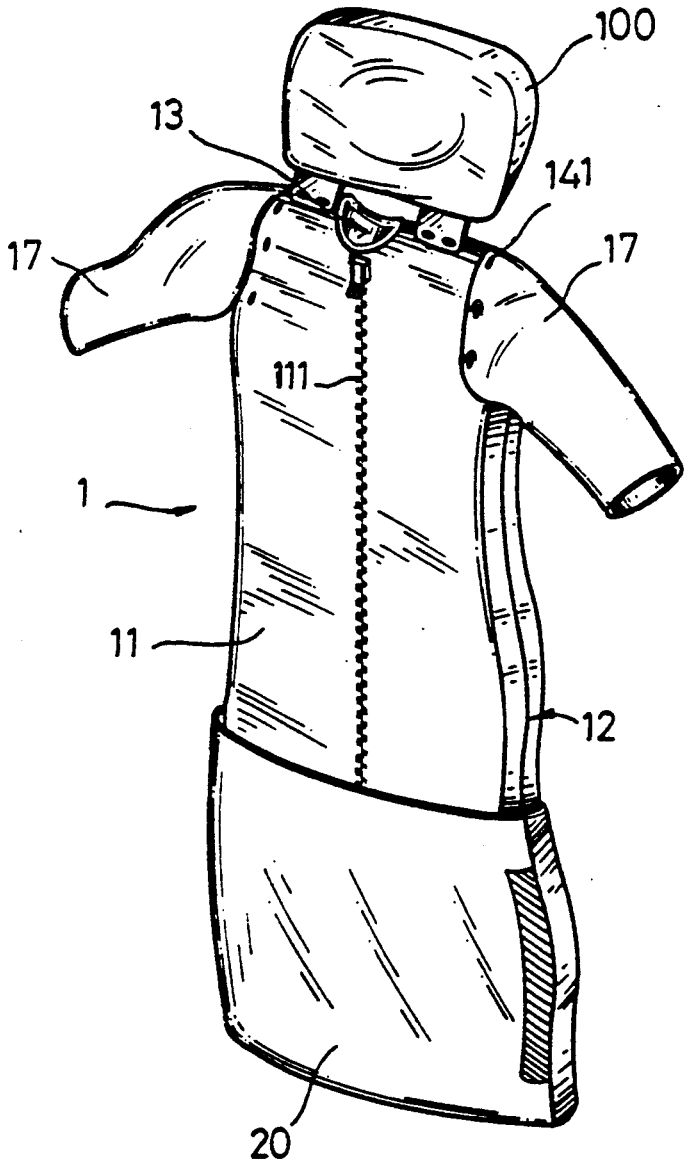
FIG. 1 is a perspective assembled view of the sleeping garment of the present invention.
Figure 2:
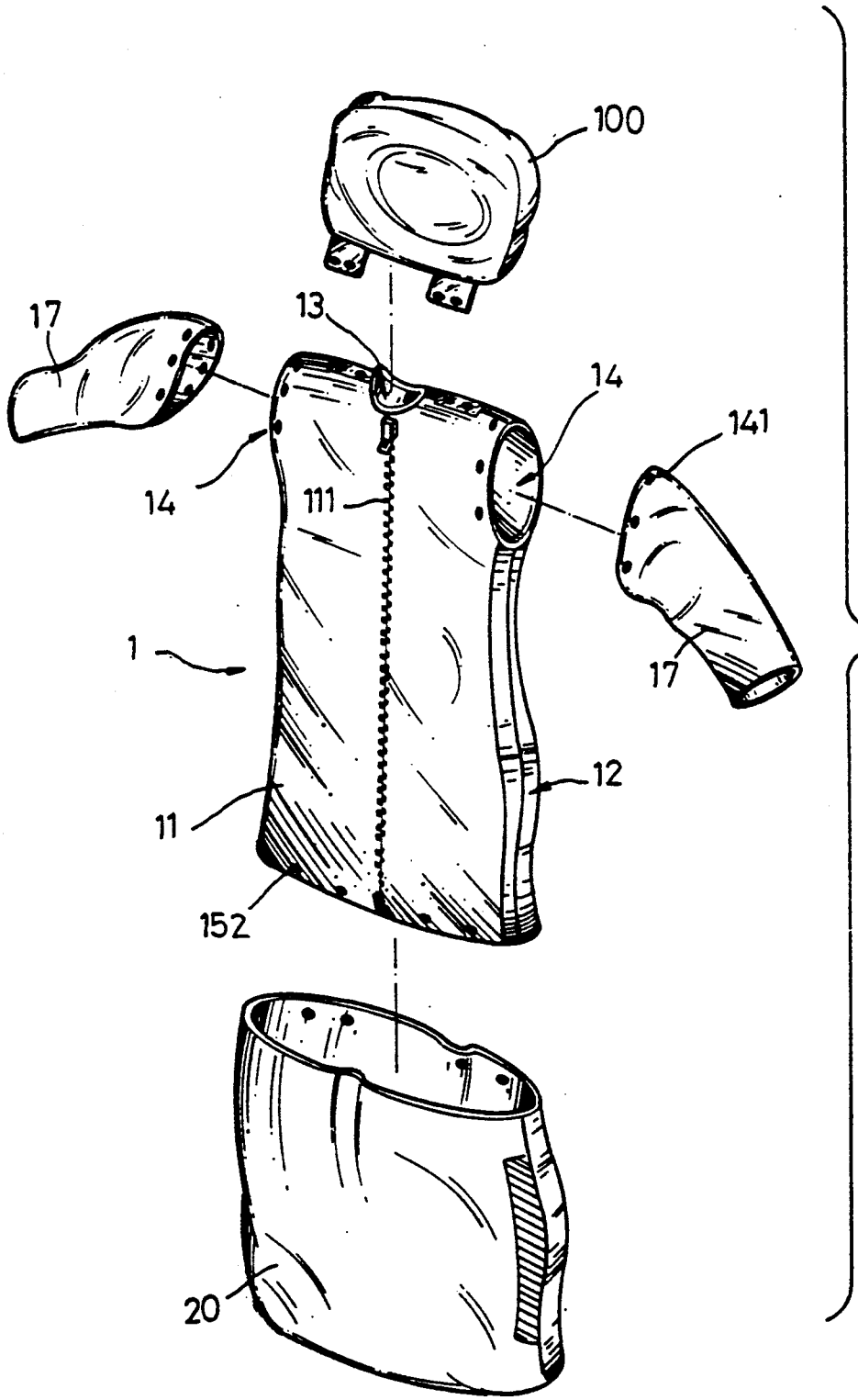
FIG. 2 is a disassembled view according to FIG. 1.
Figure 3:
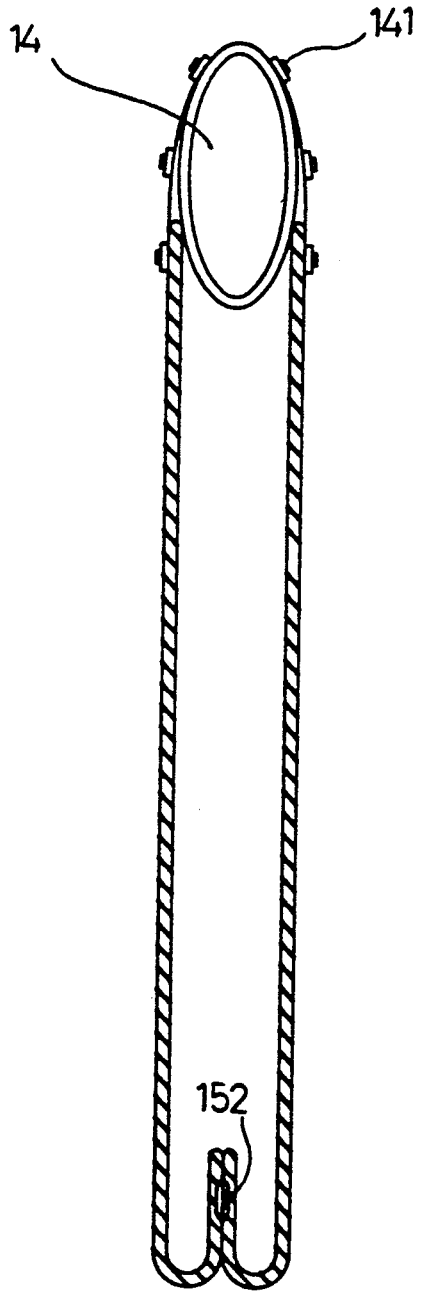
FIG. 3 is a longitudinal sectional view of the envelope of this invention.

Please first refer to FIGS. 1–4. The child's sleeping garment of this invention includes an envelope 1, a pillow 100, two sleeves 17 and an elongating bag 20 which are detachably associating with the envelope 1. The envelope 1 has a front wall 11 and a rear wall 12. The upper edge of the envelope 1 is formed with a neck opening 13 and each of two side edges of the envelope 1 is formed with an arm opening 14 so that the head and two arms of a child or an infant in the envelope may extend out therethrough. The front wall 11 of the envelope 1 can be divided into two flaps which is detachably connected by a zipper 111. The lower edge of the envelope 1, on the outer faces thereof, are provided with cooperating fasteners, such as snap fasteners 152 so that the front wall 11 of the envelope 1 can be detachably associated with the rear wall 12.

The two sleeves 17 can be secured to the arm openings 14 by snap fasteners 141 so that a child's arms can extend into the sleeves to insure safe warm sleeping, or the snap fasteners 141 can associate with each other to seal the arm openings 14. The elongating bag 20 snap fasteners 23 can be secured to the snap fasteners 152 of the envelope 1 to increase the length of the envelope.

Each arm opening 14 of the envelope 1 can be reopenably closed by snap fasteners 141 and the lower edges of the envelope 1 can be detachably associated together by snap fasteners 152 so that a child or an infant can only extend his/her head out through the neck opening 13 to insure safe warm comfortable sleeping.

When the garment of this invention is applied to a bigger child, the arm openings 14 can be opened for the child to extend out his/her arms therethrough. In case it is cold, the sleeves 17 can be secured to the arm openings 14 to achieve warming effect.

Please now refer to FIGS. 5A through 5E. The elongating bag 20 of this invention can be unfolded into a plane long rectangular plate 20. At two ends of the plate 20 are disposed two hooking tapes 22 respectively on inner and outer faces thereof whereby the hooking tapes 22 can associate with each other to fold the plate 20 into sleeve-shaped member. The upper edge of the sleeve-shaped member is provided with snap fasteners 23 which can be secured to the snap fasteners 152 located on the lower edge of the envelope 1 so that the length of the envelope 1 can be increased for prolonging the using period of the child's sleeping garment. The lower edge of the elongating bag 20 is also provided with snap fasteners 24 which can be secured together to close the elongated bag. As shown in FIG. 5A, the outer face of the elongating bag 20 is disposed with a pocket 54 so that a handle belt 55 can be received therein. Each end of the handle belt 55 is provided with a ring 56 whereby when the elongating bag 20 is folded with the snap fasteners 24 joining together at the bottom portion and snap fastener 23 joining together at the top portion, the ring 56 can be secured to either the fasteners 23 or 24 so that the handle belt 55 can associate with the elongating bag 20, forming a carrying bag for carrying and storing the sleeping garment. The elongating bag 20 can also be used alone as a stomach wrap to wrap the chest and abdomen of a child or an infant to prevent the same from catching a cold.

Figure 4:
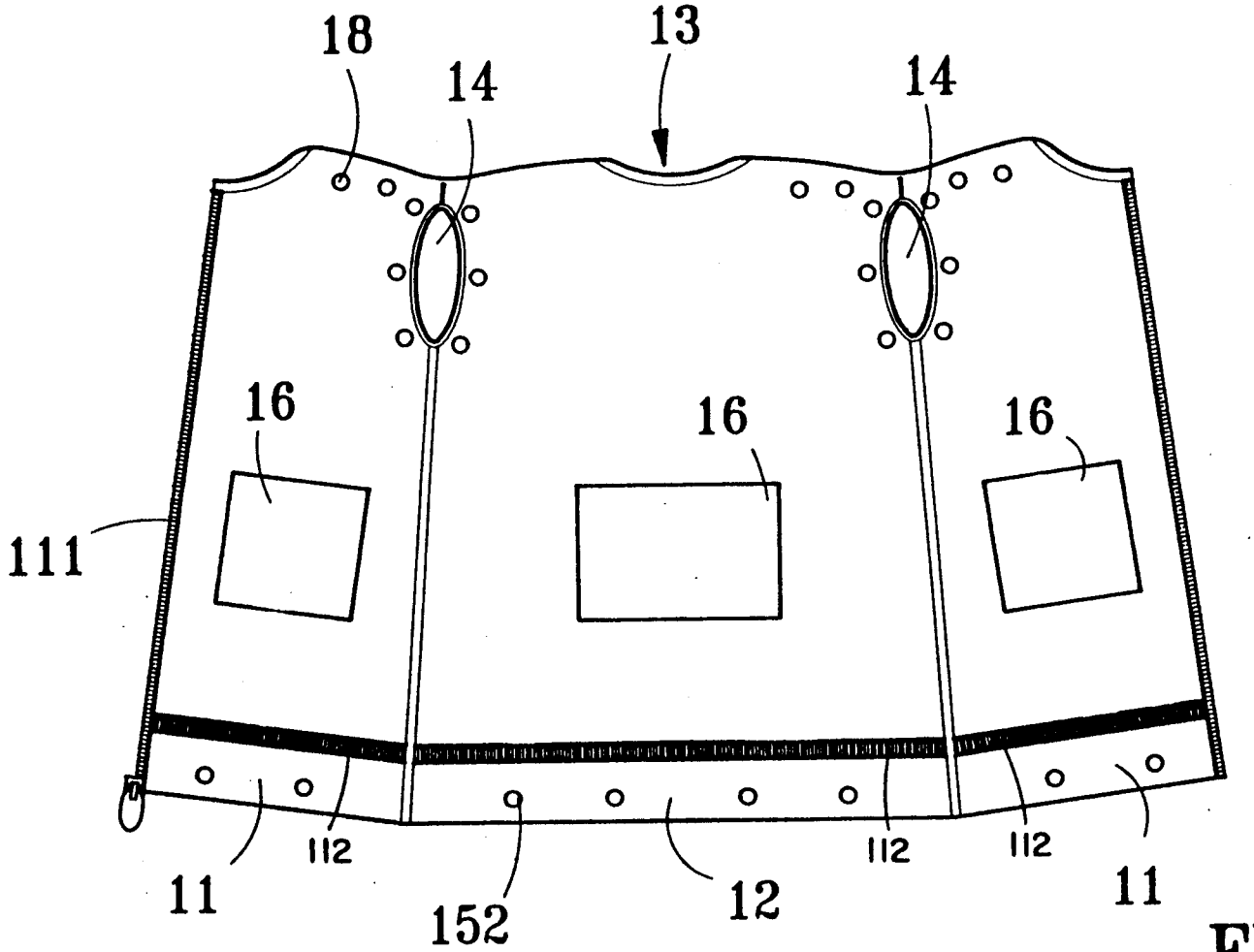
FIG. 4 shows the unfolded envelope thereof.

Referring to FIG. 4, the child's garment 1 can be unfolded after loosening the snap fasteners 18 and 152 located along the upper edge and lower edge of the envelope 1 and releasing the zipper 111. The inner faces of the child's garment may be made of cotton sheet or the like material, and as shown in FIG. 4, three sheets of waterproof linings 16 can be disposed on the inner faces of envelope 1 so as to prevent the envelope 1 from being wet by the child's urine.

Figure 6:
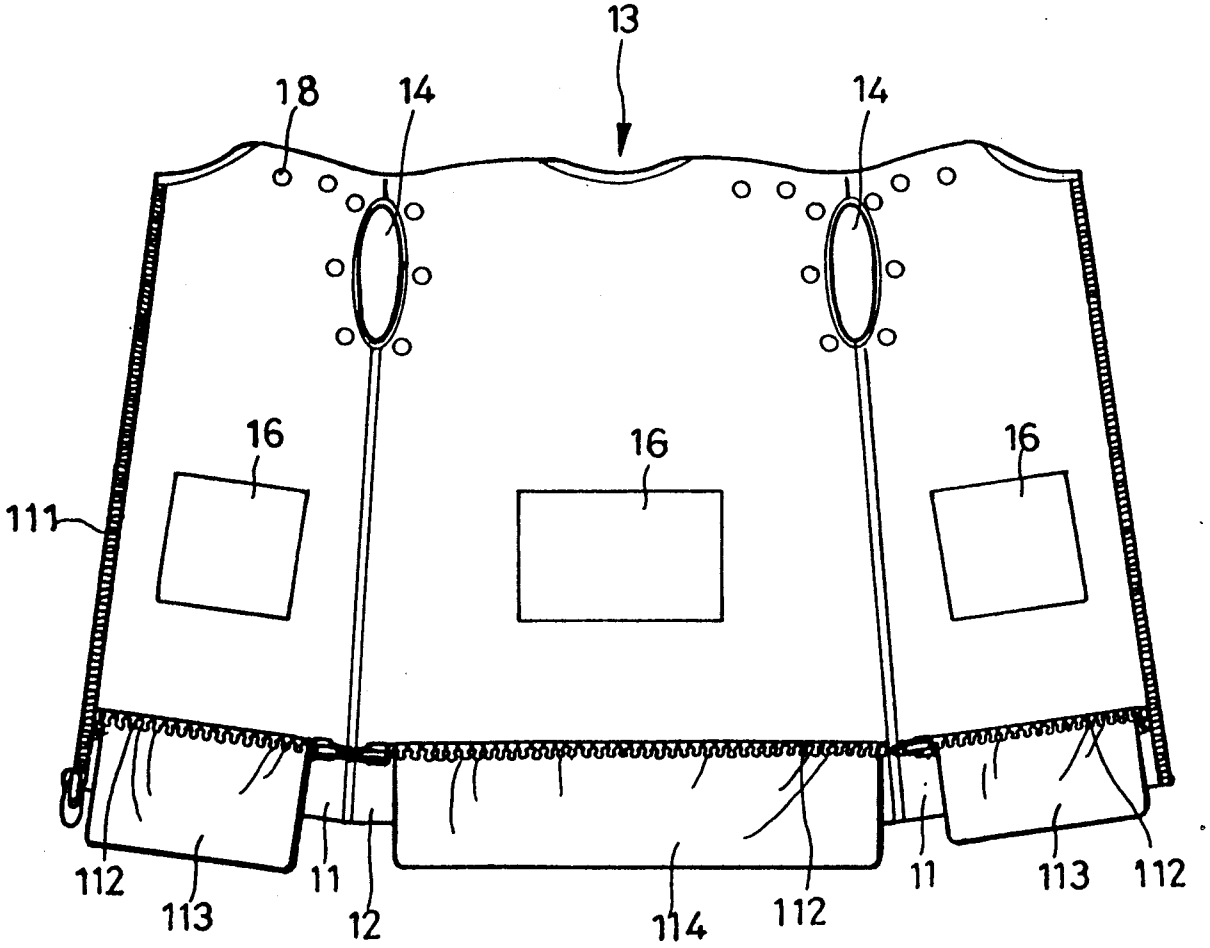

Referring to FIG. 4, three zippers 112 are disposed along the lower edge of the inner faces of the front wall 11 and rear wall 12 the envelope 1 whereby a filling 113, 114 can be affixed thereto so as to in colder time keep the child or infant in the envelope 1 warm as shown in FIG. 6.

Many changes and modifications in the above described embodiment of the invention can, of course, be carried out without departing from the scope thereof.

What is claimed is:

1. A child's sleeping garment comprising:

an envelope portion having an upper edge, a lower edge, a front wall, a rear wall, a first and a second side wall, and outer faces, said envelope portion including:

a neck opening formed at said upper end, two arm openings respectively formed on said first and said second side wall including a means for affixing disposed thereon, a means for connecting disposed along said outer faces of said lower edge of said envelope portion permitting said front wall to be detachably associated with said rear wall so said lower edge of said envelope may be sealed, said front wall comprising two flaps which are detachably connected by a zipper;

a pillow detachably associated with said envelope portion;

an elongating bag having an upper edge and lower edge, said upper edge including a means for engaging which enables said elongating bag to be detachably associated with said lower edge of said envelope portion so to lengthen said envelope portion, thus prolonging the using period of said child's sleeping garment, said elongating bag further comprising a means for joining disposed along said lower edge of said' elongating bag, said joining means may be secured together to close said elongating bag;

two sleeves including a means for securing said sleeves to said affixing means of said arm openings, said sleeves being detachably associated with said arm openings, said arm openings capable of closing by utilizing said affixing means once said sleeves are detached.

2. A child's sleeping garment as claimed in claim 1 wherein said elongating bag can be unfolded into a long rectangular plate having two ends, said ends including a fastening member so said ends may be joined to form said elongating bag.

3. A child's sleeping garment as claimed in claim 2, wherein said elongating bag further comprises a handle belt having two ends, each of which including a ring, said ring being suitable to be secured to said engaging means of said upper edge of said elongating bag so as to associate said handle belt with said elongating bag to form a carrying bag for carrying and storing said sleeping garment.

4. A child's sleeping garment as claimed in claim 3 wherein said elongating bag further comprising a pocket disposed on the outer surface thereof for receiving said handle belt.

5. A child's sleeping garment as claimed in claim 1, further comprising a means for fastening disposed on said inner faces of said lower edge of said front and rear wall, permitting an optional filling to be engaged with said fastener means, so as to keep the child warm in said envelope portion.

6. A child's sleeping garment as claimed in claim 1, wherein three sheets of waterproof linings are disposed on said inner faces of said envelope portion to prevent said envelope portion from being wet by the child's urine.

7. A child's sleeping garment as claimed in claim 2, wherein said fastening member is hooking tape.

* * * * *